US010689814B2

(12) United States Patent
Azizinamini

(10) Patent No.: US 10,689,814 B2
(45) Date of Patent: Jun. 23, 2020

(54) MODULAR RAILING FOR ON-SITE CONSTRUCTION

(71) Applicant: Atorod Azizinamini, Miramar, FL (US)

(72) Inventor: Atorod Azizinamini, Miramar, FL (US)

(73) Assignee: The Florida International University Board of Trustees, Miami, FL (US)

( * ) Notice: Subject to any disclaimer, the term of this patent is extended or adjusted under 35 U.S.C. 154(b) by 0 days.

(21) Appl. No.: 16/263,163

(22) Filed: Jan. 31, 2019

(65) Prior Publication Data

US 2019/0257043 A1 Aug. 22, 2019

Related U.S. Application Data

(60) Provisional application No. 62/710,398, filed on Feb. 16, 2018.

(51) Int. Cl.

| | |
|---|---|
| ***E01D 19/10*** | (2006.01) |
| ***E01F 15/04*** | (2006.01) |
| ***E01F 15/08*** | (2006.01) |

(52) U.S. Cl.

CPC ..... *E01D 19/10* (2013.01); *E01D 19/103* (2013.01); *E01F 15/0446* (2013.01); *E01F 15/083* (2013.01); *E01F 15/088* (2013.01)

(58) Field of Classification Search

CPC ..... E01C 3/006; E01C 9/086; E01C 11/02; E01C 2201/02; E04G 21/3223; E01D 15/12; E01D 15/133; E01D 19/086; E01D 19/10; E01D 19/103; E01D 21/00; E01D 21/06; E01F 15/0446; E01F 15/08; E01F 15/083; E01F 15/088

See application file for complete search history.

(56) References Cited

U.S. PATENT DOCUMENTS

| | | | | | |
|---|---|---|---|---|---|
| 4,067,166 | A * | 1/1978 | Sheahan | E02D 29/0241 | 405/284 |
| 4,282,619 | A * | 8/1981 | Rooney | E01D 2/04 | 14/6 |
| 4,604,841 | A * | 8/1986 | Barnoff | E01D 2/02 | 14/73 |
| 5,015,119 | A * | 5/1991 | Schmanski | E01F 7/06 | 256/13.1 |
| 5,577,284 | A * | 11/1996 | Muller | E01D 2/00 | 14/73 |

(Continued)

FOREIGN PATENT DOCUMENTS

KR 2006085144 * 7/2006

OTHER PUBLICATIONS

Machine Translation of KR 2006-0085144; http://engpat.kipris.or.kr/pmt/patent/patentRTT.jsp; Mar. 31, 2019 (Year: 2019).*

*Primary Examiner* — Ryan D Kwiecinski

(74) *Attorney, Agent, or Firm* — Saliwanchik, Lloyd & Eisenschenk

(57) ABSTRACT

A modular railing system for on-site assembly of a railing system along a roadway is provided. The modular railing system can include a deck with an edge beam along one side and a railing that can be attached to the edge beam. Attachment of the railing to the edge beam raises the joint between the deck and the railing to inhibit water seepage into the joint. In a specific embodiment, UHPC can be used to attach the railing to the edge beam.

18 Claims, 4 Drawing Sheets

(56) References Cited

U.S. PATENT DOCUMENTS

| | | | | |
|---|---|---|---|---|
| 5,697,728 | A * | 12/1997 | Camomilla | E01D 19/103 256/13.1 |
| 6,237,291 | B1 * | 5/2001 | Elwart | E02D 27/02 249/34 |
| 7,614,830 | B1 * | 11/2009 | Ritke | E02D 29/02 405/286 |
| 9,187,869 | B2 * | 11/2015 | Rainey | E01F 15/083 |
| 9,404,231 | B2 * | 8/2016 | Alberson | E01F 15/086 |
| 9,551,119 | B2 * | 1/2017 | Tirimanna | E01D 15/133 |
| 2014/0345069 | A1 * | 11/2014 | Tirimanna | E01D 19/10 14/73.1 |
| 2018/0135261 | A1 * | 5/2018 | Nelson | E01D 19/125 |

* cited by examiner

MODULAR RAILING FOR ON-SITE CONSTRUCTION

CROSS-REFERENCE TO A RELATED APPLICATION

This application claims the benefit of U.S. Provisional Application Ser. No. 62/710,398, filed Feb. 16, 2018, the disclosure of which is hereby incorporated by reference in its entirety, including all figures, tables and drawings.

This invention was made with government support under Grant No. DTRT13-G-UTC41 awarded by the Department of Transportation. The government has certain rights in the invention. This invention was made with government support under Grant No. 69A3551747121 awarded by the Department of Transportation. The government has certain rights in the invention.

BACKGROUND OF INVENTION

Approximately one-fourth of the 600,000 bridges in the United States require repair or total replacement. In many cases, the direct and indirect costs of detouring traffic as a result of the temporary loss of a bridge during construction can exceed the actual cost of the repaired or replaced structure. For example, full-lane closures in large urban centers or on highways with heavy traffic volumes can have a significant economic impact on commercial and industrial activities in the region. Even partial lane closures can have economic impact and safety issues. Because of the potential economic impact and safety issues, minimizing traffic disruptions is a high priority when planning bridge related construction projects.

The use of Accelerated Bridge Construction (ABC) uses innovative planning, design, materials, and methods to reduce construction time when building new, or replacing existing, bridges. ABC construction methods often utilize modular components that are partially or entirely built or cast off-site. Railing systems utilized on the edges or sides of bridges are an example of a construction method that utilizes modular components.

One method utilizes a modular railing system with components having a solid railing cast as part of the deck or roadway support. These modular components can be transported to the site to assemble a full railing. These combined rail and deck modular components are awkward to move and complex to place on-site. Another method utilizes a pre-cast solid rail that is transported to the site and attached to the on-site deck. This method requires post-tensioning of the rail to the deck to prohibit movement of the rail, which is time-consuming and adds expense.

Pre-fabricated rail components that are easy to transport and simple and cost efficient to install would reduce construction time. Such components would also align with the goals of ABC project planning.

BRIEF SUMMARY

The subject invention provides a modular system for construction of bridge railings where the components are easily transportable and efficient to assemble on site. The components can be fit together without need of post-tensioning and provide the further advantage of having a joint above the level of the deck. This raised joint inhibits the ingress of moisture between the deck and the railing.

One embodiment of the invention provides a pre-cast deck with an edge beam to which a pre-cast railing can be connected. A filler, such as an adhesive or adhesive-like material, can be used to permanently connect or adhere the railing to the edge beam. In one embodiment, concrete is used to connect or adhere the edge beam and the railing. In a specific embodiment, Ultra-High Performance Concrete (UHPC) is used to connect or adhere the railing to the edge beam.

The edge beam and railing can have surface features that increase surface area between the edge beam and rail to enhance or strengthen the connection or adherence. The surface features can also inhibit movement between the edge beam and the railing.

BRIEF DESCRIPTION OF DRAWINGS

In order that a more precise understanding of the above recited invention can be obtained, a more particular description of the invention briefly described above will be rendered by reference to specific embodiments thereof that are illustrated in the appended drawings. The drawings presented herein may not be drawn to scale and any reference or inference to dimensions in the drawings or the following description is specific to the embodiments disclosed. Any variations of these dimensions that will allow the subject invention to function for its intended purpose are considered to be within the scope of the subject invention.

FIG. 3A shows a tilted mounting surface and a complimentary attachment surface on the railing. FIG. 3B shows a curvilinear mounting surface and a complimentary attachment surface on the railing.

DETAILED DISCLOSURE

Figure 1:
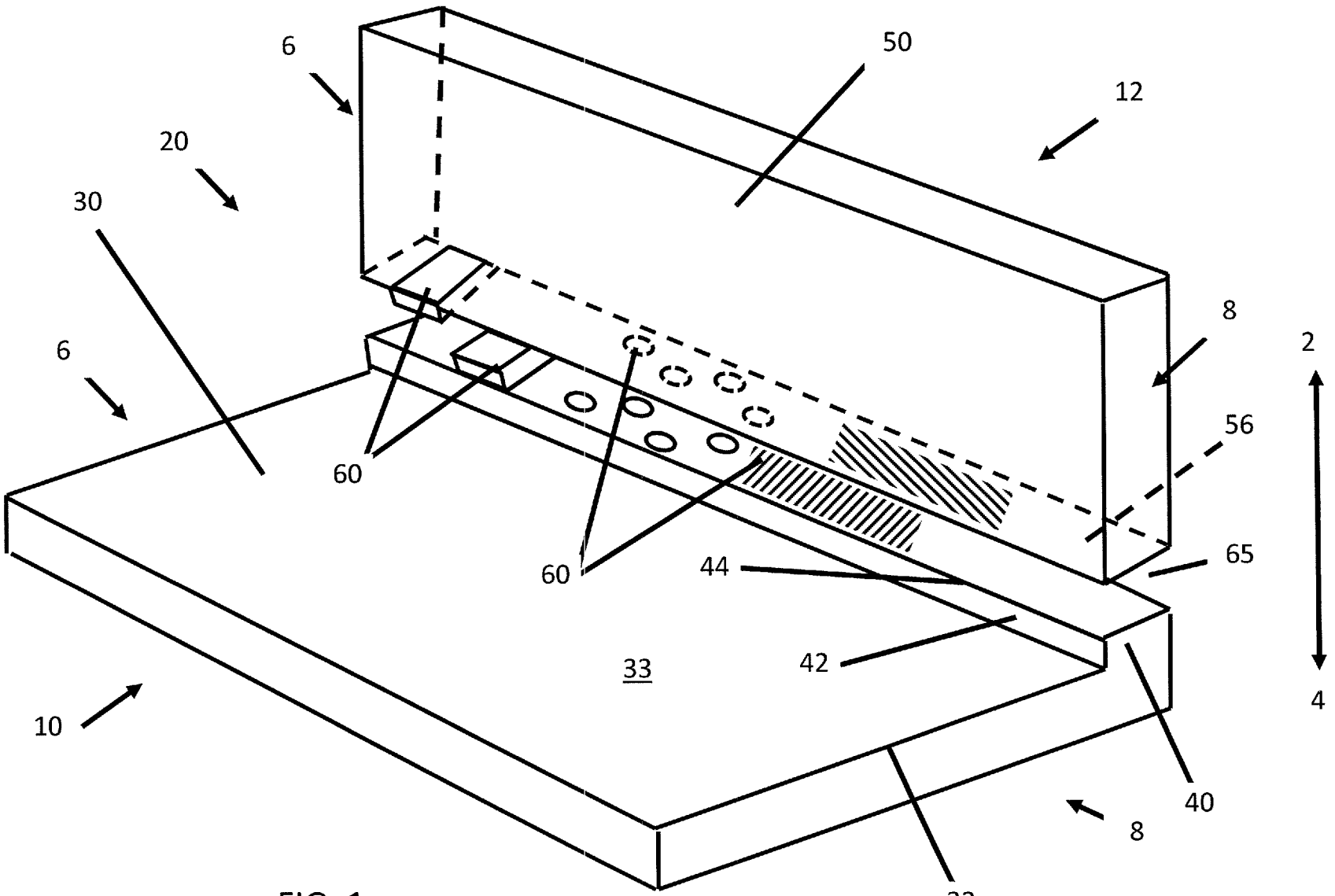
FIG. 1 illustrates the separate components of a modular railing system. Shown is a deck component having an edge beam and a railing component that can be joined or connected to the edge beam to form a joint between the edge beam and the railing.

The subject invention pertains to a modular railing system for installation along roadways. More specifically, the subject invention provides one or more embodiments of a modular railing system particularly advantageous for use on bridge roadways. Advantageously, the components of the modular railing system can be transported for on-site assembly along the roadway or bridge.

A modular railing system can include a deck with an edge beam on which a railing can be placed and attached to form the assembled railing system. The separate deck and railing are more easily transportable and can be more efficiently manipulated on-site for assembly. The modular railing system can provide a quick and cost efficient method for assembling a railing system of any length.

As used herein, and unless otherwise specifically stated, the terms "operable communication," "operable connection," "operably connected," "cooperatively engaged" and grammatical variations thereof mean that the particular elements are connected in such a way that they cooperate to achieve their intended function or functions.

The figures and descriptions of embodiments of the present invention have been simplified to illustrate elements that are relevant for a clear understanding of the invention, while eliminating, for purposes of clarity, other elements that may be well known. Those of ordinary skill in the art will recognize that other elements may be desirable and/or required in order to implement the present invention. However, because such elements are well known in the art, and because they do not facilitate a better understanding of the present invention, a discussion of such elements is not provided herein.

As used herein, the term "longitudinal length" refers to a measurement or direction taken along the longest axis. For example, the longitudinal length of a railing is the distance or direction between the first end and the second end.

The term "about" as used herein, in conjunction with a numerical value, means that the value can be in a range of 95% of the value to 105% of the given value, i.e. the value can be +/−5% of the stated value. For example, "about 1 inch" means from 0.95 inch to 1.05 inch. When the term "about" is used in parentheses before a numerical value, it should be understood as a shorthand way to express that the value can be the exact number (or endpoint) or can be about that number (or endpoint).

Finally, reference is made throughout the application to the "proximal end" or "proximal direction" and "distal end" or "distal direction." As used herein, the proximal end or proximal direction is that end directed upwards or away from a roadway. Conversely, the distal end or distal direction is that end directed downwards or towards a roadway.

The present invention is more particularly described in the following examples that are intended to be illustrative only because numerous modifications and variations therein will be apparent to those skilled in the art. As used in the specification and in the claims, the singular for "a," "an" and "the" include plural referents unless the context clearly dictates otherwise.

Reference will be made to the attached Figures on which the same reference numerals are used throughout to indicate the same or similar components. With reference to the attached Figures, which show certain embodiments of a the subject invention, it can be seen in FIG. 1 that a modular railing system 20 of the subject invention comprises a deck 30 with an integrated edge beam 40 and a railing 50 that can be operably engaged with the edge beam to form a joint 65 therebetween. Advantageously, the joint is above the deck level 32, which can inhibit seepage of water and other materials into the joint. Each of these general components can have one or more sub-components, which will be discussed in detail below.

Figure 5:
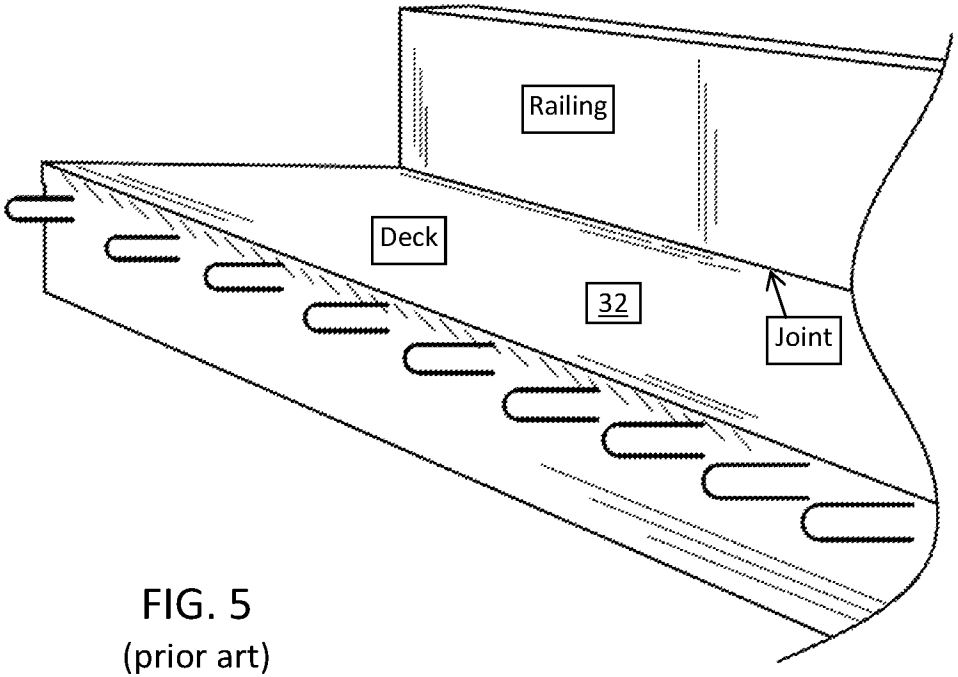
FIG. 5 (prior art)
FIG. 5 (prior art) is an illustration of a modular railing with a deck component and railing that is attached directly to the deck surface to form a joint between the deck and the railing that is at the deck level.

As seen in FIG. 1, a deck 30 can have a slab surface 33 that can be attached to other slab surfaces, such as those used to form a roadway or slab surfaces of other decks placed at the first end 6 and/or the second end 8 of the deck. Typically, when constructing a railing on a slab deck, the rail portion is set directly on the slab surface, such as shown in FIG. 5, and held in place with a layer of concrete between the slab surface and the railing. This can position the joint at the deck level 32. Embodiments of the subject invention provide the unique advantage of incorporating an edge beam 40 along a longitudinal length of a backside 12 of the deck. The deck and edge beam can be separate components that are assembled or connected, such that there is a joint between the deck and the edge beam. In a preferred embodiment, the deck and edge beam form a monolithic structure, such that are formed as a single unit. This can eliminate the formation of a joint between the deck and the edge beam. The longitudinal length of a deck can be between (about) 10' and (about) 50'.

In one embodiment, an edge beam 40 defines a raised area along the back side 12 of the deck. The edge bean can have a barrier wall 42 along the front side 10. The barrier wall can be continuous along the longitudinal length of the edge beam. Alternatively, the barrier wall can be discontinuous. For example, there can be drain openings 43 that lead to the backside 12 of the edge beam, as shown, for example, in FIG. 2. The barrier wall can rise from (about) 4" to (about) 12" above the deck level 32.

Figure 2:
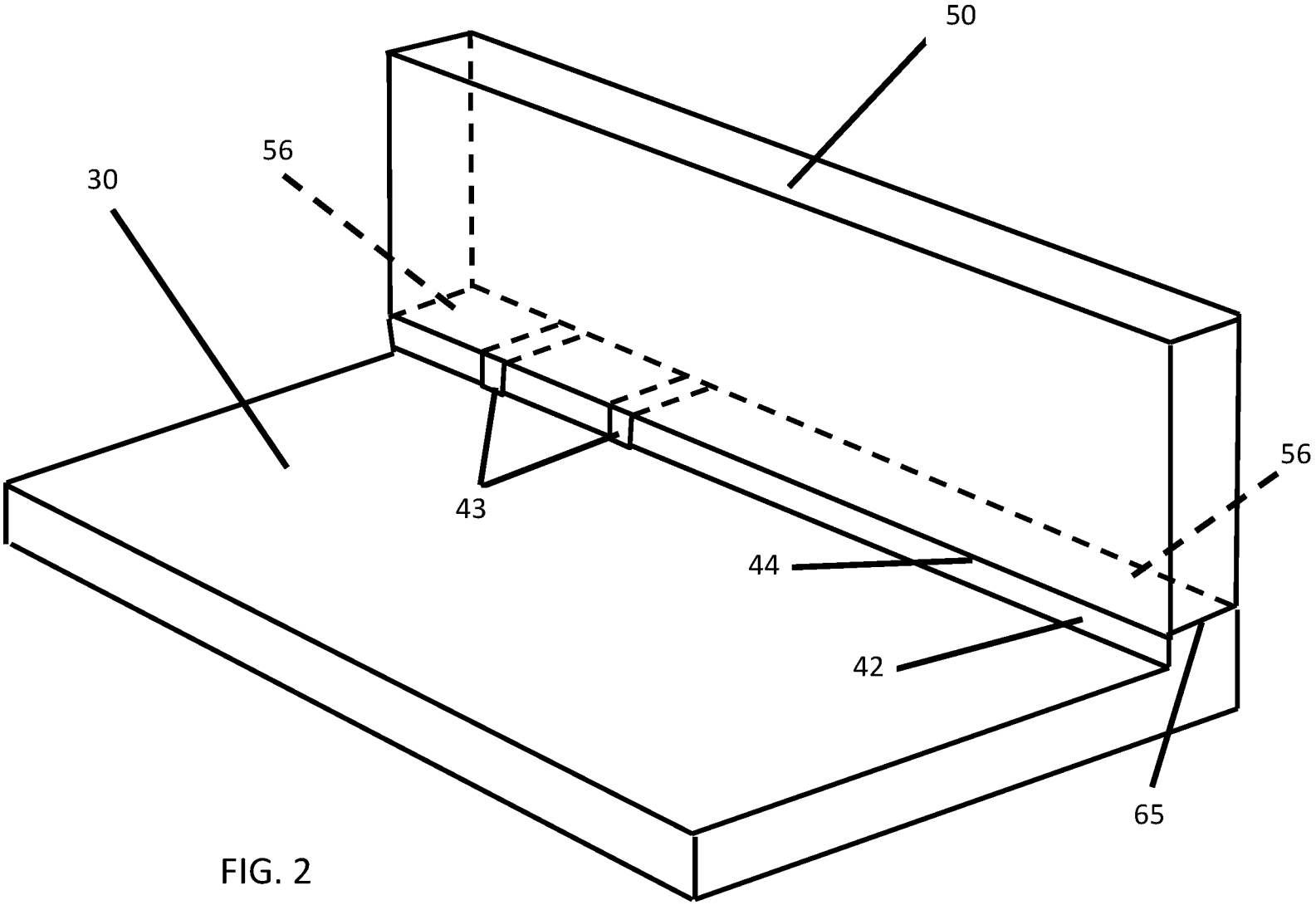
FIG. 2 illustrates a modular railing system with a connected deck component and railing component.
Figure 3B:
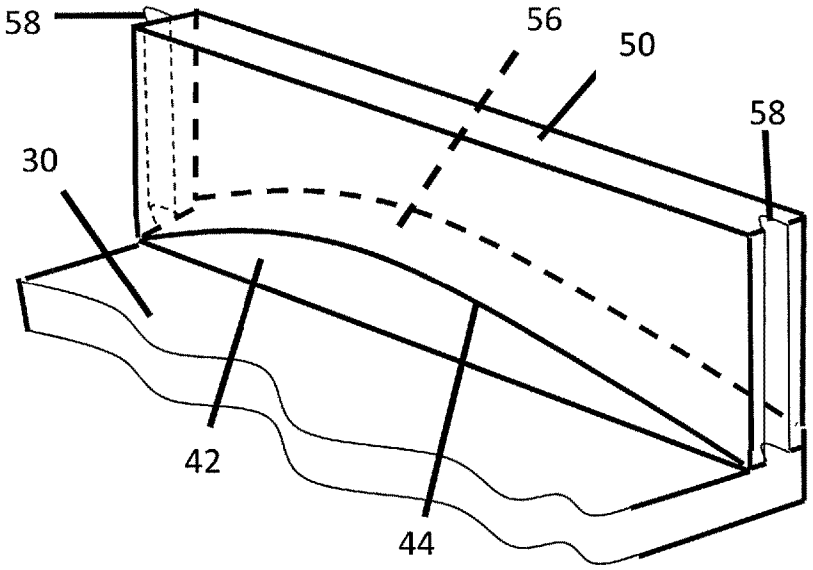
FIGS. 3A and 3B show examples of alternative non-horizontal mounting surfaces on a deck.
Figure 3A:
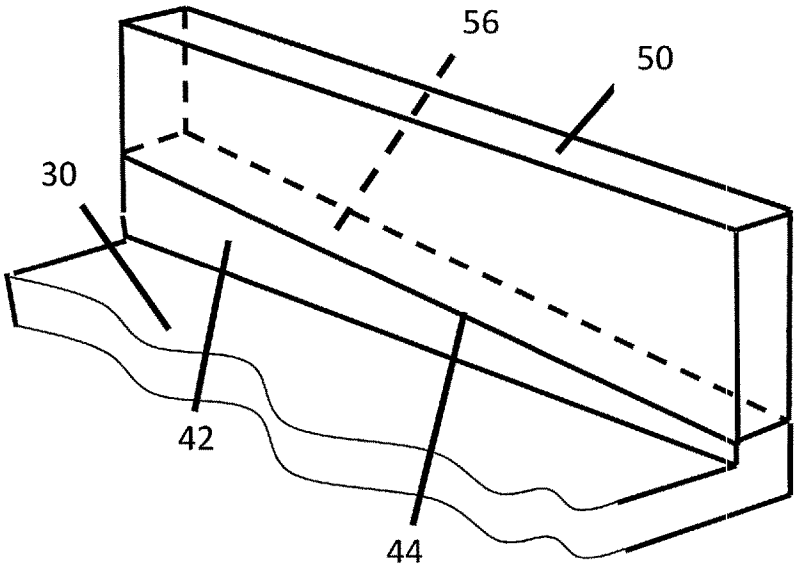

The upper end 2 of the barrier wall terminates in a mounting surface 44 on which a railing can be placed and attached, as shown in the example in FIG. 2. In one embodiment, the mounting surface is horizontal to the slab surface 33. In an alternative embodiment, the mounting surface is not horizontal to the slab surface 33. By way of non-limiting example, the mounting surface can be tilted towards the first end 6 or the second end 8, as shown in FIG. 3A. By way of a further non-limiting example, the mounting surface can be curvilinear, as shown in FIG. 3B. A non-horizontal mounting surface can facilitate correct positioning of a rail on the mounting surface. The distance between the front side 10 and the backside 12 of the mounting surface can be from (about) 6" to (about) 20."

A railing 50 can be attached, coupled, joined, connected, or otherwise fixed to the mounting surface 44. A railing can have any of a variety of configurations. Preferably, a railing is configured to inhibit a vehicle from leaving the roadway. There are laws in each State that dictate the standards for roadway railings, including, but not limited to the height of the railing, manufacturing materials, thickness at the upper end 2 and the lower end 4. Embodiments of the subject invention can be configured and manufactured to meet requirements in each State.

In one embodiment, a railing is a solid concrete structure. Reinforcements are often used in large concrete structures and can also be utilized with a railing of the subject invention. As mentioned above, a deck can have a longitudinal length of from (about) 10' to (about) 50'. Likewise, a railing can have a longitudinal length equivalent to that of the deck to which it is attached. A railing can be placed on the edge beam 40 of a deck with the railing and deck aligned, such as shown in FIG. 2. Alternatively, a railing can be placed across two decks so as to be offset over the two decks.

Figure 4:
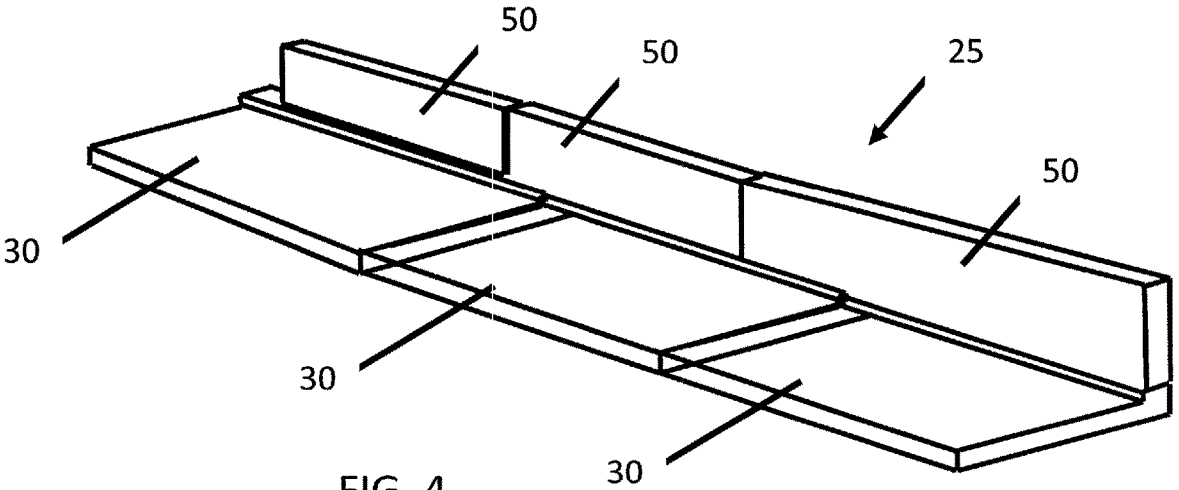
FIG. 4 illustrates examples of railings of different lengths and an example of a railing that spans two decks.

In another embodiment, a railing can have a longitudinal length that is not equivalent to the longitudinal length of deck. For example, a railing can have a longitudinal length that is shorter than the longitudinal length of the deck to which it is attached. In another example, a railing can have a longitudinal length that is longer than the deck to which it is attached. With this embodiment, multiple railings can be placed in an offset manner on a deck, such that at least one of the railing spans two, or more, decks. FIG. 4 illustrates examples of railings of different longitudinal lengths and non-limiting examples of how they can be arranged offset on the edge beam of a deck, including spanning over two edge beams of two decks.

In a further embodiment, a railing 50 has an attachment surface 56 configured to be placed against the mounting surface 44, as shown, for example, in FIGS. 2-3B. The attachment surface can be at the lower end 4 of the railing. As mentioned above, the mounting surface 44 of an edge beam 40 can be horizontal to the slab surface 33 or can be non-horizontal to the slab-surface. In a further embodiment, the attachment surface is configured to be compatible with or complimentary to the mounting surface. Thus, if the mounting surface is horizontal, the attachment surface 56 will have a complimentary horizontal shape. Alternatively, if the mounting surface is non-horizontal, for example, tilted or curvilinear, the attachment surface can have a shape that is complementary and attachment to that of the mounting surface.

To hold the railing in place on the mounting surface 44 of an edge beam 40, a filler can be used between the mounting surface and the attachment surface 56. The filler can be an adhesive or adhesive-like material that can form a joint 65 between the deck 30 and the railing 50. More specifically, the adhesive or adhesive-like material can form a joint between the edge beam 40 of the deck and the railing. In one embodiment, the filler material is concrete. In a more specific embodiment, the filler is Ultra High Performance Concrete (UHPC). UHPC and the advantages thereof are known in the art and can also be advantageous for use in attaching a deck and railing of the subject invention.

To further facilitate the attachment of the railing, more specifically, the mounting surface 44 to the attachment surface 56, one or more surface features 60 can be employed on one or both of the mounting surface and attachment surface. Surface features can include, but are not limited to, grooves, dents, projections, nibs, raised areas, indentations, rough, abrasive areas, or other features that can increase the surface area to which the filler can form an attachment. Surface features can also inhibit movement of the railing on the edge beam 40. For example, surface features can interlock or interdigitate so secure the railing against the edge beam. FIG. 1 illustrates non-limiting examples of different types of surface features.

The first end 6 and/or the second end 8 can also be configured with interlocking features 58. Interlocking features can allow a first end 6 of a railing to be interlocked or coupled to a second end 8 of another railing. For example, a railing can be designed with a tongue and groove interlocking feature wherein a first end is configured with a tongue and a second end is configured with a complimentary groove. An example of a tongue and groove arrangement on a railing is shown in FIG. 3B. When two railings are placed beside each other, the tongue of the first rail can interlock with the groove of the second rail. Other interlocking features, known to those with skill in the art, could also be used with a railing of the subject invention.

One method of employing a modular railing system 20 of the subject invention to construct an assembled railing system 25 along a roadway comprises manufacturing a deck 30 and an edge beam 40 as a monolithic structure. A railing 50 can be manufactured according to required State specifications. The deck and railing can be transported as separate components to a roadway site. Preferably, the number of decks and railings necessary to complete an assembled modular railing system 20 are manufactured and/or transported to the roadway site. If a slab deck for the roadway has been set, a deck of the assembled railing system can be positioned so as to be joined or connected to the existing roadway slab deck. If a slab deck for the roadway has not been set, the deck can be placed for future attachment to the roadway slab deck. Decks can be positioned with the edge beam furthest from the roadway slab deck.

The first railing can be raised and positioned over the mounting surface of the edge beam with the attachment surface facing the mounting surface. Just prior to positioning the railing on the mounting surface, filler, such as UHPC, or other adhesive or adhesive-like material, can be layered, poured, sprayed, dropped, or otherwise disposed on the mounting surface. The railing can then be lowered onto the mounting surface and allowed to remain in place until the filler has cured.

Another deck can be positioned against the first end or the second end of the first deck and attached to the first end or the second end utilizing filler, such as, for example, UHPC or other adhesive or adhesive-like material. A second railing can be positioned on the second deck, as described above, also utilizing filler between the first railing and the second railing. This process can be repeated until an assembled railing system of sufficient length has been positioned along the roadway.

Roads, bridges, and other infrastructure have to eventually be repaired or replaced. The economic impact of rerouting or slowing traffic on a roadway to accommodate such repairs or replacements can be significant. Efforts to reduce the amount of time necessary have resulted in a variety of pre-manufactured structures that can be transported to a site and quickly assembled. Pre-fabricated railings have been difficult to transport or have not resulting in significant time or cost savings. The embodiments of the subject invention provide a modular railing system with components that are easy to transport and assemble on-site. The use of an edge beam also solves a problem that has existed with other railings wherein water seepage between the railing and the slab deck has reduced the life-span of the railing. The modular railing system is an improvement over the existing methods and devices for constructing railings and aligns with ABC standards.

All patents, patent applications, provisional applications, and other publications referred to or cited herein are incorporated by reference in their entirety, including all figures and tables, to the extent they are not inconsistent with the explicit teachings of this specification. Additionally, the entire contents of the references cited within the references cited herein are also entirely incorporated by reference.

The examples and embodiments described herein are for illustrative purposes only and that various modifications or changes in light thereof will be suggested to persons skilled in the art and are to be included within the spirit and purview of this application.

What is claimed is:

1. A modular railing system, configured to be assembled along a roadway, comprising:

a deck having a slab surface that defines a deck level configured for incorporation into the roadway and an edge beam having a barrier wall rising from the deck level to an upper end that terminates in a mounting surface above the slab surface and roadway, the mounting surface comprising a longitudinal length between a first end and a second end of the deck that is non-horizontal, relative to the slab surface, the deck and the edge beam having an equivalent longitudinal length; and a concrete railing having an attachment surface that is complimentary with and fixable to the non-horizontal longitudinal length of the mounting surface, such that fixing the attachment surface to the mounting surface forms an immoveable joint above the deck level and roadway, and interlocking features on a first end of the railing and on a second end of the railing for interlocking two or more of the concrete railings above the immovable joint.

2. The modular railing system, according to claim 1, wherein the barrier wall rises between about 6" and about 12" above the deck level.

3. The modular railing system, according to claim 1, further comprising surface features on at least one of the mounting surface and the attachment surface.

4. The modular railing system, according to claim 3, wherein the surface features interlock.

5. The modular railing system, according to claim 1, wherein the attachment surface is non-horizontal.

6. The modular railing system, according to claim 1, wherein the deck has a longitudinal length that is different from a longitudinal length of the concrete railing.

7. The modular railing system according to claim 1, wherein the non-horizontal mounting surface is curvilinear.

8. The modular railing system according to claim 1, wherein the non-horizontal mounting surface is tilted towards one or more of the first end and the second end.

9. A method for constructing a railing system along a roadway comprising:

providing at a roadway site a modular railing system, according to claim 1;

positioning the deck to be incorporated with a slab surface of the roadway with the edge beam furthest from and the mounting surface above the roadway slab surface;

raising the railing above the edge beam;

and lowering the railing onto the mounting surface.

10. The method, according to claim 9, wherein the railing is lowered across the mounting surfaces of two or more decks.

11. The method, according to claim 9, further comprising aligning the interlocking features on a first end of a railing with the interlocking features on a second end of another railing.

12. The method, according to claim 9, further comprising aligning the attachment surface with the non-horizontal mounting surface.

13. The method, according to claim 9, further comprising surface features on at least one of the mounting surface and the attachment surface and the method further comprising lowering the railing so that the surface features embed within the filler.

14. The method, according to claim 13, wherein the surface features interlock and the method further comprises interlocking the surface features when lowering the railing.

15. The method, according to claim 9, further comprising applying a filler comprising Ultra High Performance Concrete (UHPC) to at least one of the mounting surface and the attachment surface.

16. A kit for a modular railing system comprising:

a modular railing system, according to claim 1; and filler.

17. The kit, according to claim 16, wherein the deck has a longitudinal length that is different from a longitudinal length of the railing.

18. The kit, according to claim 16, wherein the filler comprises Ultra High Performance Concrete (UHPC).

* * * * *